US008833825B2

(12) United States Patent
Holmes

(10) Patent No.: US 8,833,825 B2
(45) Date of Patent: Sep. 16, 2014

(54) MANTLE LIFTING DEVICE AND METHOD FOR LIFTING A MANTLE

(75) Inventor: Brett Gregory Holmes, Helena Valley (AU)

(73) Assignee: Crushing and Mining Equipment Pty Ltd, Western Australia (AU)

( * ) Notice: Subject to any disclaimer, the term of this patent is extended or adjusted under 35 U.S.C. 154(b) by 0 days.

(21) Appl. No.: 13/395,098

(22) PCT Filed: Sep. 3, 2010

(86) PCT No.: PCT/AU2010/001145
§ 371 (c)(1),
(2), (4) Date: Jun. 26, 2012

(87) PCT Pub. No.: WO2011/029133
PCT Pub. Date: Mar. 17, 2011

(65) Prior Publication Data

US 2013/0043697 A1 Feb. 21, 2013

(30) Foreign Application Priority Data

Sep. 8, 2009 (AU) ..... 2009904290

(51) Int. Cl.
*B66C 1/00* (2006.01)

(52) U.S. Cl.
USPC ..... 294/93; 294/215

(58) Field of Classification Search
USPC ..... 294/93, 89, 215, 67.32, 82.1, 94
See application file for complete search history.

(56) References Cited

U.S. PATENT DOCUMENTS

| | | | | | |
|---|---|---|---|---|---|
| 1,776,776 | A | * | 9/1930 | Blackmarr | 294/86.17 |
| 2,566,507 | A | * | 9/1951 | Walraven et al. | 294/93 |
| 3,355,114 | A | * | 11/1967 | Motz | 241/293 |
| 3,750,967 | A | | 8/1973 | DeDiemar et al. | |
| 4,017,115 | A | * | 4/1977 | Holt et al. | 294/89 |
| 4,018,470 | A | * | 4/1977 | Tye | 294/89 |

(Continued)

FOREIGN PATENT DOCUMENTS

| | | |
|---|---|---|
| CA | 1 159 425 | 12/1983 |
| GB | 2 188 253 A | 9/1987 |

OTHER PUBLICATIONS

International Preliminary Report on Patentability issued on Mar. 13, 2012, for PCT Application No. PCT/AU2010/001145, five pages.

*Primary Examiner* — Saul Rodriguez
*Assistant Examiner* — Gabriela Puig
(74) *Attorney, Agent, or Firm* — Morrison & Foerster LLP

(57) ABSTRACT

Mantle lifting device (10) has a body (26) configured to selectively engage and disengage an opening (24) of a mantle (12) by rotation in respective opposite directions about a central axis (28) of the body (26). The body (26) is provided with a lifting point (30) which is configured to couple with a lifting device such as a crane (not shown). The body (26) is in the general form of a plug having an upper surface (34) and an opposite surface (36) and tapered circumferential surfaces (38 and 40). The surface (40) is provided with indicia (43) commencing at a distance d on the surface (40) below the edge (42). This is used to indicate safe or unsafe lifting conditions. The indicia (43) being visible when the device (10) is engaged with the mantle (12) is an indication that the mantle (12) is worn to the extent that it may not be safe to lift the mantle (12) by way of the device (10), or at least not without additional safety precautions being taken.

28 Claims, 5 Drawing Sheets

(56) References Cited

U.S. PATENT DOCUMENTS

| | | | | | |
|---|---|---|---|---|---|
| 4,179,151 | A | * | 12/1979 | Tye | 294/89 |
| 4,315,651 | A | * | 2/1982 | Endicott et al. | 294/82.17 |
| RE31,131 | E | * | 1/1983 | Torbet et al. | 294/89 |
| 4,477,030 | A | | 10/1984 | Vifian et al. | |
| 4,784,398 | A | * | 11/1988 | Lund | 279/2.16 |
| 5,323,976 | A | * | 6/1994 | Johnson et al. | 241/286 |
| 7,216,823 | B2 | | 5/2007 | Delille | |
| 2007/0090566 | A1 | * | 4/2007 | Westhoff et al. | 264/274 |
| 2010/0213728 | A1 | * | 8/2010 | Hoellriegl et al. | 294/87.1 |

* cited by examiner

MANTLE LIFTING DEVICE AND METHOD FOR LIFTING A MANTLE

CROSS REFERENCE TO RELATED APPLICATIONS

This application is a National Phase application under 35 U.S.C. §371 of International Application No. PCT/AU2010/001145, having an International Filing Date of Sep. 3, 2010, which claims priority to Australian Application No. AU 2009904290 filed on Sep. 8, 2009, each of which is incorporated herein by reference in its entirety.

FIELD OF THE INVENTION

The present invention relates to a mantle lifting device for lifting a mantle from a cone crusher. The invention also relates to a method of lifting a mantle.

BACKGROUND OF THE INVENTION

A typical cone crusher comprises an offset cone head which gyrates about a central axis. To protect the cone head from wear, a mantle is attached to and overlies the cone head. During operation as the cone head gyrates about the central axis rock is crushed between the mantle and a bowl liner. The mantle has a substantially frusto conical shape with an opening at a small diameter end. The opening has a tapered surface that decreases in diameter in a direction toward a large diameter end of the mantle. The mantle is attached to the cone head by a torch ring (a washer) that contacts the tapered opening of the mantle, and a mantle nut that passes through the washer and threadingly engages a mantle bolt. A protective mantle nut cap/feed plate overlies and is normally bolted to the mantle nut. The mantle and mantle nut are typically spot welded in two or three locations to the torch ring.

The mantle requires regular replacement due to wear. In order to replace a worn mantle, the mantle nut cap is removed, and the torch ring cut with an oxy torch. The cutting of the torch ring enables the mantle nut to be more easily removed. In order to now lift the mantle from the cone head, lifting lugs are welded onto the mantle. The lugs are generally manufactured on site using readily available materials which are unlikely to be load rated. Due to the type of steel used in the manufacture of mantles, the welding process requires specialised procedures and welding consumables otherwise the weld will become brittle and fail. There have been many instances over the years where mantles have detached from the lugs during lifting due to poor quality welding creating substantial hazard and causing injuries such as amputation of feet.

While new mantles are often provided with lifting points cast into them, some need to be cut off before use while others simply wear away during use. The present invention was developed to provide an alternate mechanism and method for lifting mantles that can be used on a new or worn mantle.

SUMMARY OF THE INVENTION

According to one aspect of the invention there is provided a mantle lifting device for facilitating lifting of a mantle provided with an axial opening, the mantle lifting device comprising:

- a body configured to selectively engage with and disengage from an opening in a mantle;
- the body comprising a lifting point configured to coupled with a lifting device wherein the lifting device can lift the mantle when the body is engaged with the mantle and the lifting point is engaged with the lifting device.

The body may be configured to at least partially fit in the opening and comprise one or more members to selectively engage with and disengage from the opening.

In one embodiment the one or more members may be fixed to the body wherein the mantle lifting device is engaged and disengaged from the mantle by rotation of the body relative to the mantle in respective opposite directions.

In this embodiment the one or more members may extend radially from a circumferential surface of the body.

In an alternate embodiment the one or more members may be selectively extendible from and retractable into the body wherein the mantle lifting device is: engaged with the mantle by locating the body in the opening and extending the one or more members from the body; and, disengaged from the mantle by retracting the one or more members into the body.

The mantle lifting device may comprise two or more members equally spaced about the body.

The lifting point may comprise a lug coupled to an upper surface of the body.

The mantle lifting device may comprise a releasable locking mechanism for locking the body when engaged with the mantle against disengagement from the mantle.

The releasable locking mechanism may comprise a bolt movable supported on the device the bolt being selectively movable into and out of a seat formed in the mantle.

A second aspect of the invention may provide a mantle for a cone crusher comprising:

- a substantially frustoconical wall having a large diameter end and an axially opposite small diameter end, the small diameter end configured to receive a mantle lifting device according to the first aspect of the invention;
- wherein the opening is provided with a circumferential wall and at least one recess formed in the circumferential wall to selectively engage with and disengage from the mantle lifting device.

The circumferential wall of the opening in the mantle may be formed between first and second edges, and the recess comprises a first portion that extends axially between the first and second edges, and a second contiguous portion which extends circumferentially and under cuts the first edge.

A third aspect of the invention may provide a method of lifting a mantle comprising:

- providing a mantle lifting device according the first aspect of the invention;
- configuring an opening in a mantle to enable selective engagement with and disengagement from the mantle lifting device;
- inserting the mantle lifting device into the opening and manipulating the mantle lifting device to engage the mantle lifting device with the mantle;
- coupling the lifting point with a lifting device; and,
- operating the lifting device to lift the mantle.

BRIEF DESCRIPTION OF THE DRAWINGS

An embodiment of the present invention will now be described by way of example only with reference to the accompanying drawings in which.

DETAILED DESCRIPTION OF THE PREFERRED EMBODIMENTS

Figure 1:
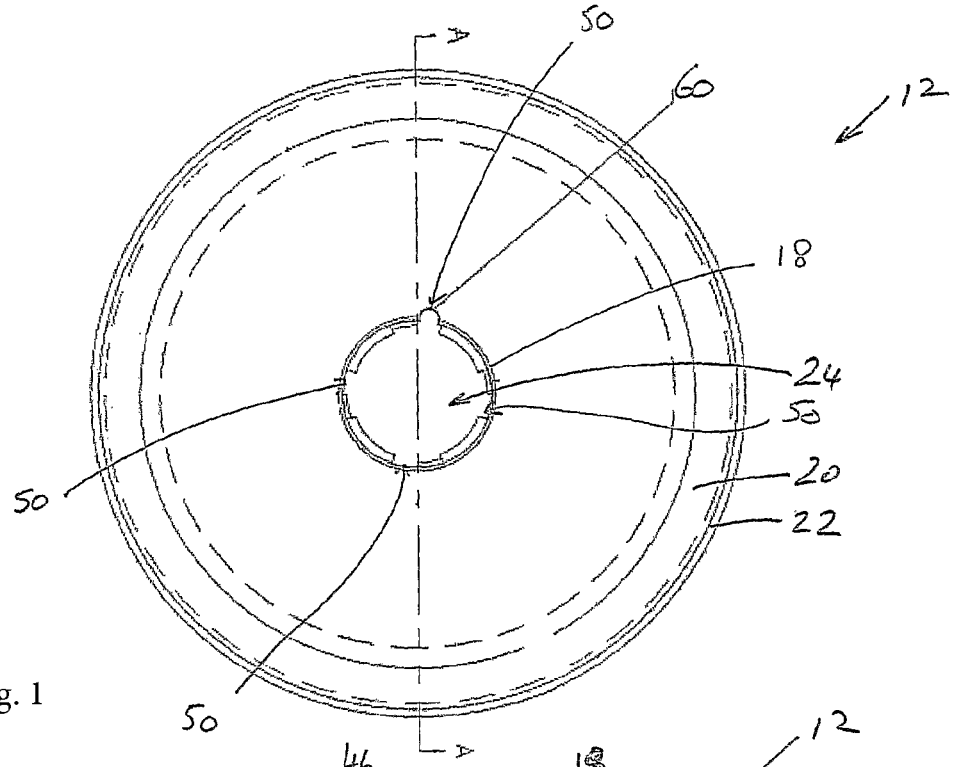
FIG. 1 is a plan view of a mantle which can be lifted with a mantle lifting device in accordance with an embodiment of the invention.
Figure 2:
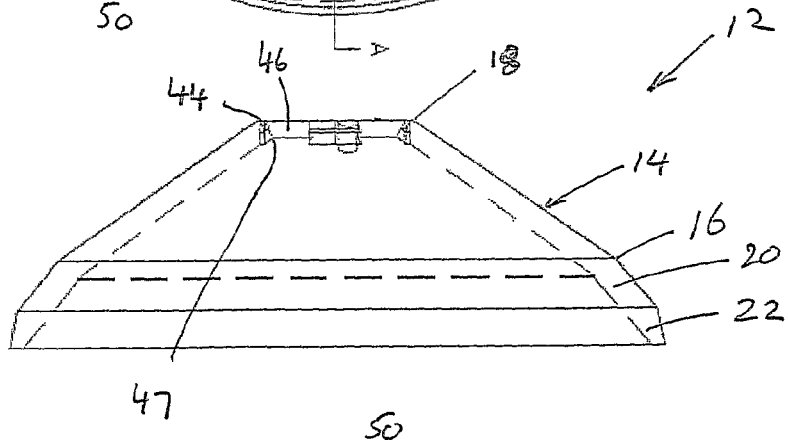
FIG. 2 is a side view of the mantle shown in FIG. 1.
Figure 3:
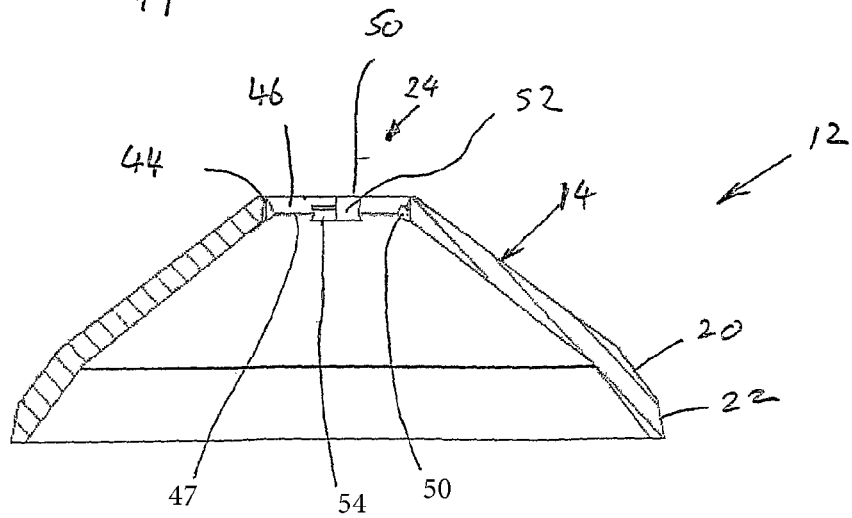
FIG. 3 is a view of section A-A of the mantle shown in FIG. 1.
Figure 4:
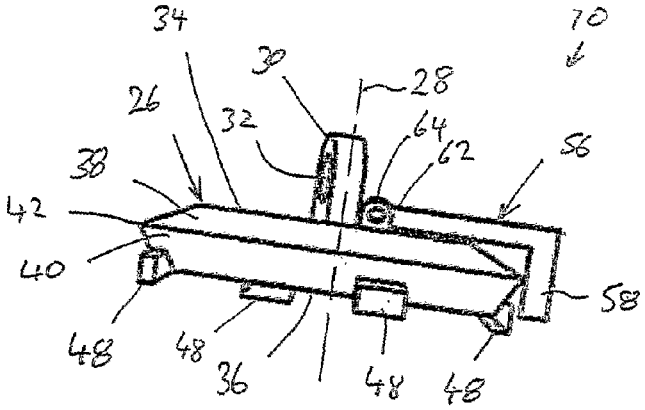
FIG. 4 is a schematic representation of a mantle lifting device in accordance with an embodiment of the present invention.
Figure 5:
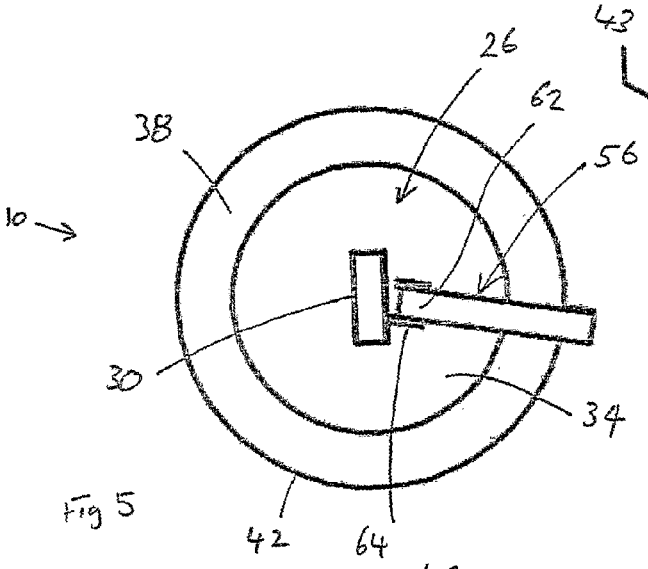
FIG. 5 is a top plan view of the mantle lifting device.
Figure 7:
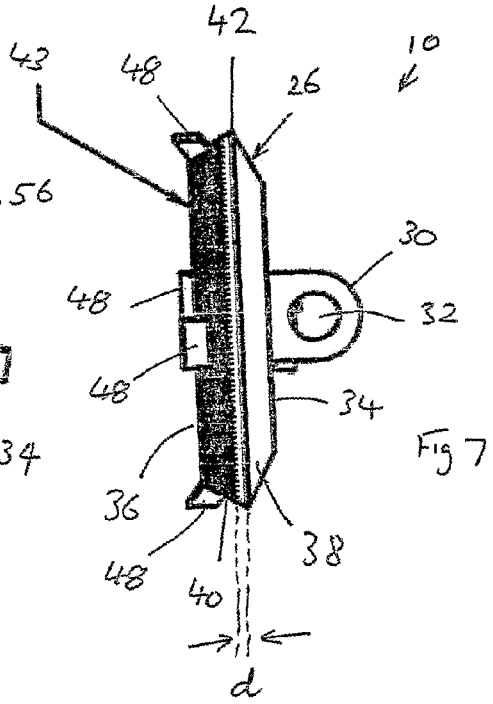
FIG. 7 is a side view of the mantle lifting device.
Figure 6:
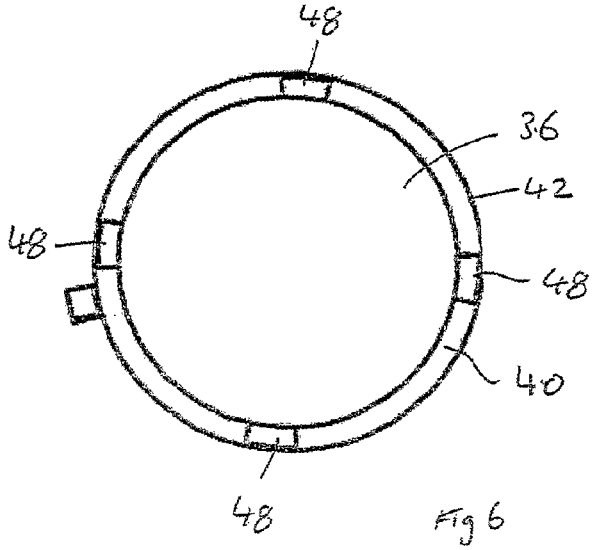
FIG. 6 is a bottom plan view of the mantle lifting device.
Figure 9:
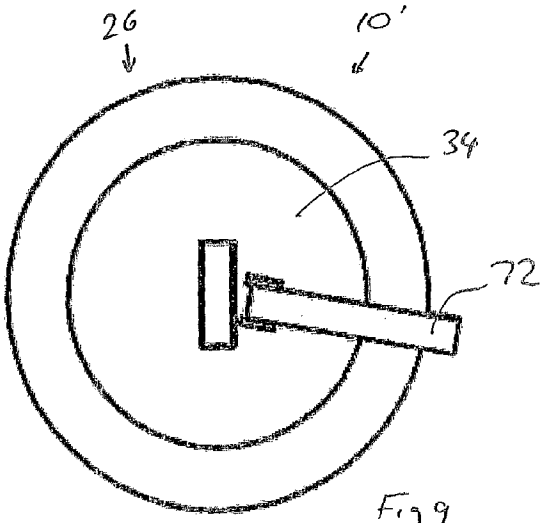
FIG. 9 is a top plan view of the lifting device shown in FIG. 8.

FIGS. 1-7 of the accompanying drawings illustrate a first embodiment of a mantle lifting device 10 and an associated mantle 12 for a cone crusher. The mantle 12 has a portion 14 of a substantially frustoconical shape having a large diameter end 16, and a small diameter end 18. Depending from the large diameter end 16 is a contiguous first band 20 having an increased slope relative to the portion 14, and a second contiguous band 22 of increased slope relative to that of the first band 20. An opening 24 is formed in the mantle 12 at the small diameter end 18.

The mantle lifting device 10 comprises a body 26 which is configured to selectively engage and disengage the opening 24 of the mantle 12 by rotation in respective opposite directions about a central axis 28 of the body 26. When the body 26 is aligned with the hole 24, the axis 28 coincides with a central axis of the mantle 12. The body 26 is provided with a lifting point 30 which is configured, by virtue of the existence of a hole 32, to couple with a lifting device such as a crane (not shown). Thus, when the mantle lifting device 10 is engaged to lift the mantle 12, and the lifting point 30 is engaged with the lifting device, the lifting device can be operated to lift the mantle. This enables the mantle to be placed on or removed from a cone head of a cone crusher.

The body 26 is in the general form of a plug having an upper planar surface 34 and an opposite planar surface 36 and two tapered circumferential surfaces 38 and 40. The circumferential surface 38 is contiguous with the upper surface 40 while the circumferential surface 40 is contiguous with the bottom surface 36. The surfaces 38 and 40 are contiguous with each other and meet to form a circumferential edge 42 which defines the largest diameter of the device 10. The surface 40 is provided with indicia 43 in this instance a coating of paint commencing at a distance d on the surface 40 below the edge 42. This is used to indicate safe or unsafe lifting conditions. The indicia 43 being visible when the device 10 is engaged with the mantle 12 is an indication that the mantle 12 is worn to the extent that it may not be safe to lift the mantle 12 by way of the device 10, or at least not without additional safety precautions being taken.

When the device 10 is seated in the opening 24, the edge 42 lies adjacent an upper edge 44 of the opening 24. An inner circumferential surface 46 of the opening 24 is bound by the edge 44 and a lower edge 47 of smaller diameter. Thus the surface 46 tapers in diameter in a direction from edge 44 toward edge 47. The tapering of the surface 46 is complimentary to the tapering of the surface 40 on the device 10 so that there is substantially face to face contact between the surfaces 40 and 46 when the device 10 is engaged in the opening 24.

The device 10 is provided with, in this embodiment, four members 48 that extend generally radially from the circumferential surface 40. The members 48 are configured to fit in corresponding recesses 50 formed in the opening 24 and more specifically in the surface 46. Each recess 50 comprises a first portion 52 that extends in an axial direction from upper edge 44 to the lower edge 47. The recess 50 also comprises a second portion 54 which is contiguous with the first port 52 and extends in a circumferential direction undercutting the upper edge 44.

In order to engage the device 10 with the mantle 12, the device 10 is placed into the opening 24 with the members 48 aligned with the first portion 52 of the recesses 50. When the device 10 is seated in the opening 24 with the surfaces 40 and 46 in mutual contact, the device 10 can then be rotated in an anticlockwise direction so as to locate the members 48 in the second portion 54 of the recesses 50. The device 10 is now engaged with the mantle 12. Thus the mantle 12 can be lifted by connecting the device 10 via the lifting point 30 to a lifting device such as a crane. Once the mantle 12 has been lifted and placed in a desired location, the device 10 can be disengaged by simply rotating the device 10 in a clockwise direction so that the members 48 are aligned with the first portions 52 of the recesses 50. The degree of rotation required to engage and disengage the device 10 is less than 180° and in one embodiment may be between say 10°-30°.

In order to minimise the risk of accidental disengagement of the device 10 from the mantle 12 during a lifting operation, a locking mechanism 56 may be incorporated in the device 10. In one embodiment the locking mechanism 56 comprises a bolt or pin 58 that can be moved into an out of a seat 60 formed in the opening 24 of the mantle 12. The seat 60 may coincide with the first portion 52 of one of the recesses 50. The mechanism 56 comprises a right angle arm having an upper arm 62 which is pivotally connected at one end to a bracket 64, with the bolt 58 extending at right angles to and from an opposite end of the upper arm 62. When the members 48 are located in the second portion 54 of a respective recesses 50, the bolt 58 can be dropped into the seat 60 by pivoting of the arm 56 to lie the upper arm 62 against the upper surface 34 of the body 26. This prevents rotation of the device 10.

Figure 8:
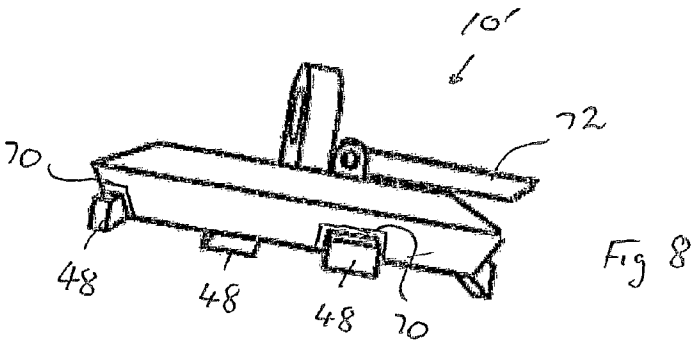
FIG. 8 is a perspective view of the second embodiment of a mantle lifting device illustrating respective members in an extended position.
Figure 10:
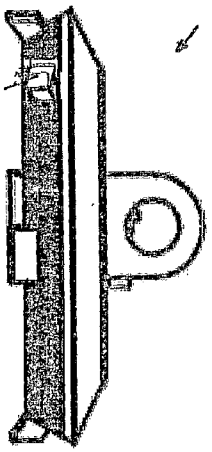
FIG. 10 is a side view of the mantle lifting device shown in FIGS. 8 and 9.
Figure 11:
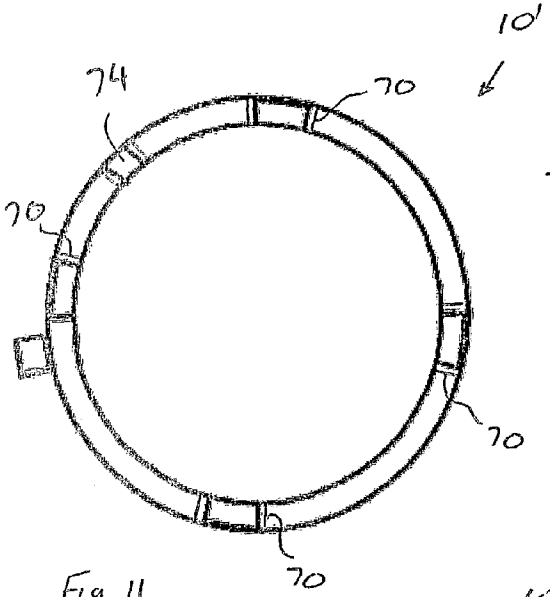
FIG. 11 is a bottom plan view of the mantle lifting device shown in FIGS. 8-10.
Figure 12:
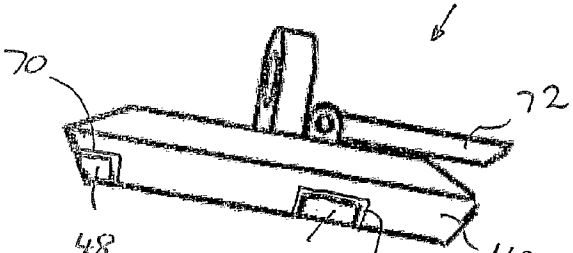
FIG. 12 is a perspective view of the mantle lifting device shown in FIG. 8 but with the members in a retracted position.
Figure 13:
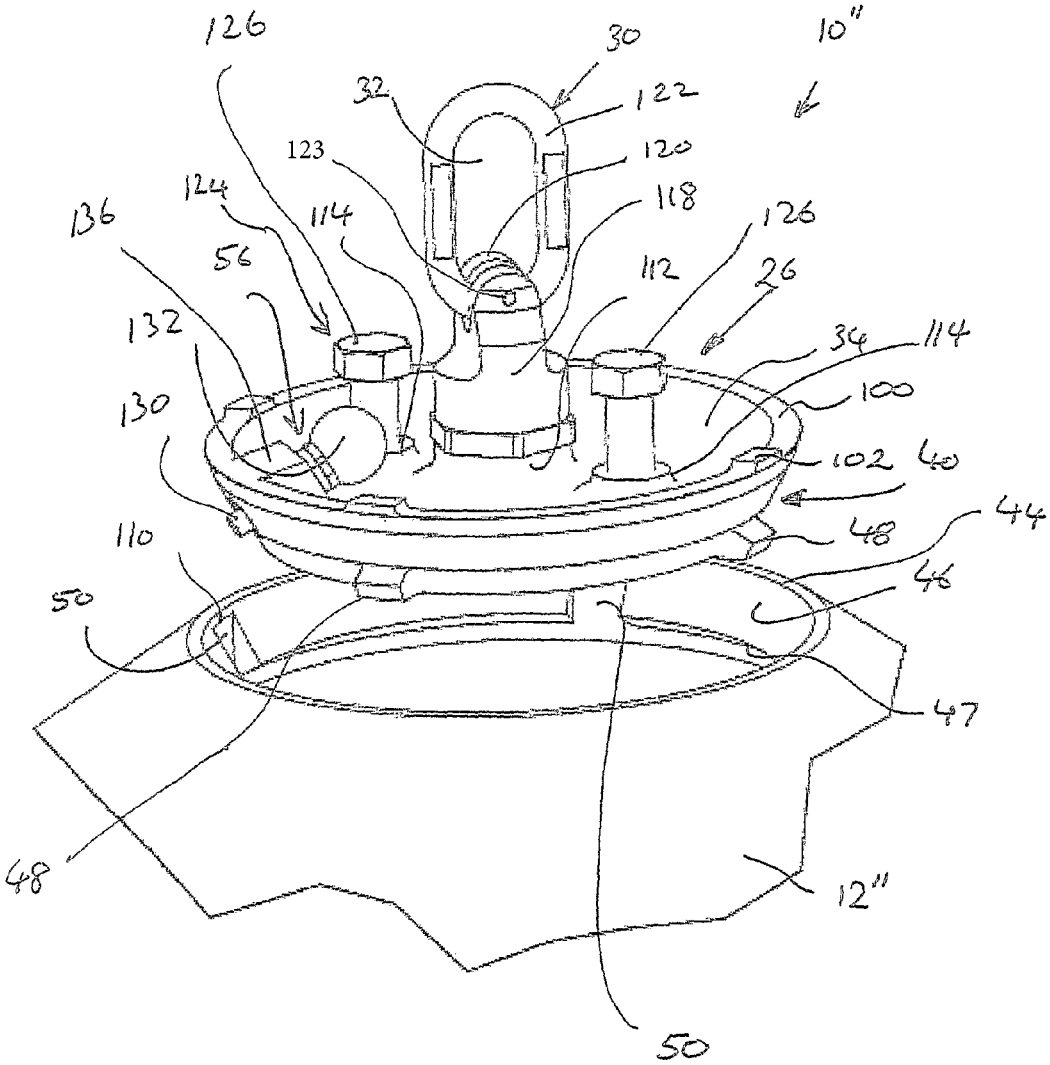
FIG. 13 is an isometric view of a third embodiment of a mantle lifting in accordance with the present invention.

FIGS. 8-12 depict a second embodiment of the mantle lifting device 10' where the same reference numbers are used to denote the same or similar features of the device 10 shown in FIGS. 4-7. The substantive difference between the mantle lifting device 10' of FIGS. 8-12 and the device 10 is the retractable nature of the members 48 in the device 10'. In the device 10', the members 48 are able to selectively retract into or extend from the body 26. This enables the device 10 to be engaged with the mantle 12 by simply seating the device 10 in the opening 24 and manipulating or otherwise operating the device 10' to extend the members 48 from the body 26. When the members 48 are extended from the body 26 and are engaged in corresponding recesses in the opening of the mantle 12, the device 10' can be coupled with a lifting mechanism such as a crane or winch to lift the mantle. The device 10' may be disengaged from the mantle 12 by manipulating or operating the device 10' to retract the members 48 into the body 26. In one possible form of the device 10', the members 48 may be in the form of rectangular or round pins which slide linearly into and out of the body 26 along corresponding passages 70 that open onto the circumferential surface 40 of the body 26. The extension and retraction of the members 48 may be via any appropriate mechanism such as a cam plate (not shown) which may be operated by rotating an actuation lever 72 accessible from the upper surface 34 of the body 26. Thus rotation of the handle 72 in one direction causes the members 48 to extend from the body 26 as shown in FIG. 8, while rotation of the handle 72 in the opposite direction retracts the members 48 into the body 26 as shown in FIG. 12 to allow disengagement of the device 10'. In this embodiment, the device 10' may also be provided with a locating protrusion 74 which, when located in a corresponding recess in the opening 24 of the mantle 12, aligns the members 48 with corresponding second portions 54 of the recesses in the opening 24 and into which the members 48 can extend to engage the device 10' to the mantle 12.

In a variation the plug 10' can be dimensional and/or configured so that the members 48, when extended from the body 26, lie beneath the lower edge 47 of the opening 24 in the mantle 12. In this variation of the mantle lifting device, the device may be used with a mantle which is not provided with recesses 50.

The mantle lifting device 10' may also be provided with a locking mechanism to releasably lock the device 10' in the engaged position.

FIGS. 13-17 depict a third embodiment of the mantle lifting device 10" and an associated mantle 12" for a cone crusher. Features of the mantle lifting device 10" that are the same or similar in form or function as those previously described in relation to the mantle lifting device shown in FIGS. 4-7 are denoted by the same reference numbers. As with the mantle lifting devices 10 and 10', mantle lifting device 10" comprises a body 26 provided with a lifting point 30 which defines a hole 32 to enable coupling to a lifting device such as a crane. Four members 48 extend in a radially outward direction from body 26. Members 48 are configured to fit in corresponding recesses 50 formed in an opening 24 of mantle 12". Mantle 10" also is provided with a locking mechanism 56 which can be moved into and out of a seat formed in opening 24 of mantle 12" to prevent accidental disengagement device 10" for mantle 12" during lifting operation. The operation of device 10" is in essence the same as that described in relation to the previous embodiments. To engage device 10" with mantle 12", device 10" is orientated so that members 48 are aligned with corresponding recesses 50 and device 10" is then lowered so that members 48 are received within the recesses 50. Locking mechanism 56 is retracted either automatically by contact with surface 46 of opening 24 or manually. In this embodiment, members 48 lie below edge 44 when device 10" is fully seated within opening 24. The device 10" can now be rotated to a location where the members 48 lie directly beneath a portion of edge 47 rather than in alignment with recesses 50, and locking mechanism 56 engages a seat or hole formed in surface 46. While device 10" operates in substantially the same manner as devices 10 and 10' it does however incorporate several physical and functional differences.

As explained below some of these differences also result in a different configuration of mantle 12" in order to enable use of device 10". These differences are described as follows. Upper surface 34 and device 10" has a generally concaved configuration as shown clearly in FIG. 13. Further, lower surface 36 is also provided with a central dished portion. Upper surface 34 is bound by a planar annular surface 100 on which is provided member indicia 102. Each indicia 102 is in the form of a generally rectangular projecting land which is located in axial alignment with a corresponding member 48. Thus when plug 10" is engaged in mantle 12", the member indicia 102 provide a user with a visual reference as to the location of the members 48.

The configuration of the circumferential surface of device 10" is also different to that of the other embodiments. In device 10", circumferential surface 40 extends between upper and lower surfaces 34 and 36. However, as most clearly shown in FIG. 17 circumferential surface 40 comprises an intermediate band 104 contiguously formed on opposite sides with an upper band 106 and lower band 108. The bands 104-108 are tapered so as to reduce in outer in a direction from upper surface 32 to lower surface 36. Indeed, the rate of taper in each of the surfaces is the same. However, intermediate band 104 has a greater outer diameter than bands 106 and 108 so as to protrude radially. When device 10" is in use, it is the band 104 which abuts inner circumferential surface 46 of mantle 12". Members 48 extend from lower band 108. Members 48 and band 108 are dimensioned or otherwise configured so that members 48 enter recesses 50 on surface 46 at a location below upper edges 110 that lie below upper edge 44. However, recesses 50 open onto lower edge 47 of surface 46.

Figure 14:
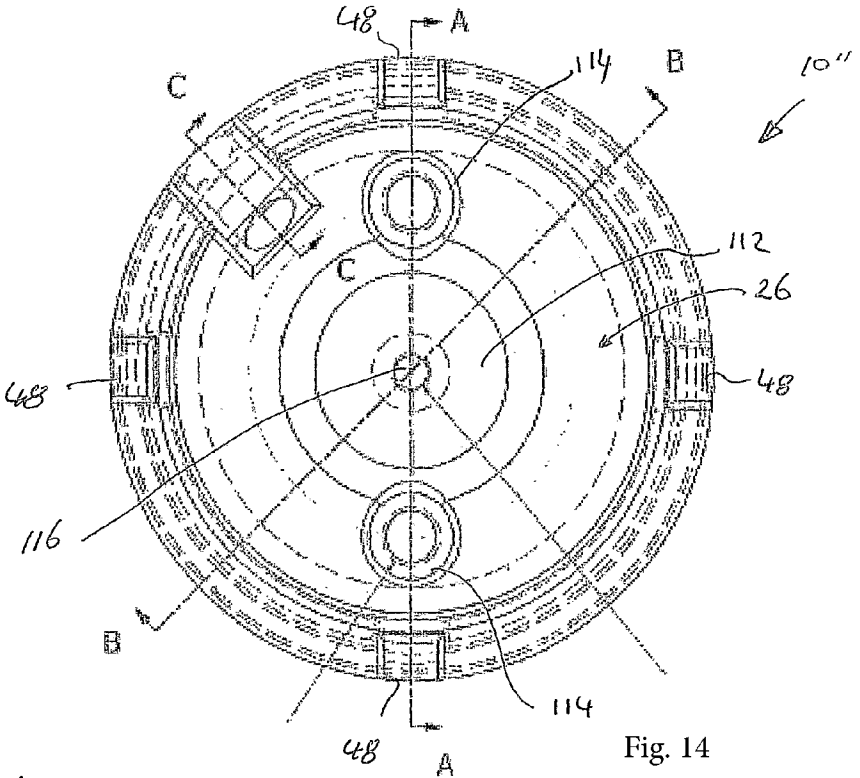
FIG. 14 is a top elevation of the mantle lifting device shown in FIG. 14.
Figure 15:
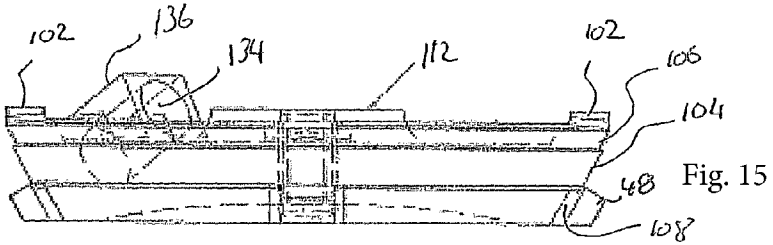
FIG. 15 is a front view of the mantle lifting device shown in FIG. 14.
Figure 16:
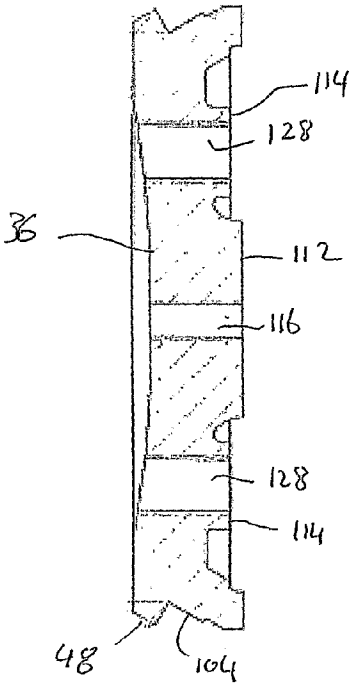
FIG. 16 is a view of section A-A of the mantle lifting device shown in FIG. 14.
Figure 17:
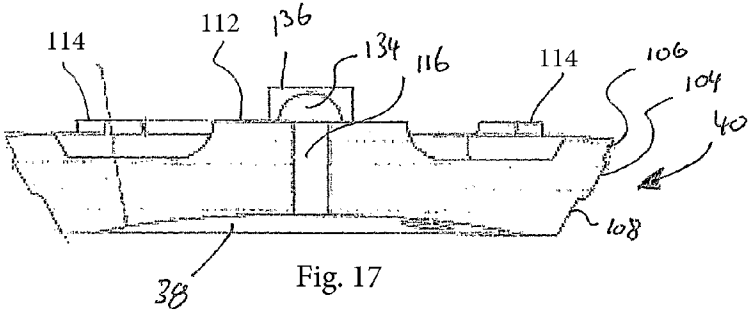
FIG. 17 is a view of section B-B of the mantle lifting device shown in FIG. 14.

In addition to being dished, upper sufrace 34 is provided with a central boss 112, and two diametrically opposed smaller bosses 114. As shown in FIG. 14, bosses 112 and 114 lie along a common diameter of body 26. Boss 112 is provided with a central through hole 116 to enable attachment of the lifting point 30. More particularly, hole 116 is formed with a thread to enable threaded coupling of lifting point 30 to body 26. Lifting point 30 comprises a body portion 118 provided with a threaded shaft that screws into hole 116, and a bifurcation 120 in which a ring 122 is engaged by a pivot pin 123.

Device 10" also incorporates a jack system 124. The jack system 124 comprises bolts 126 threadingly engaged in axial through holes 128 formed through bosses 114. Jack system 124 is operable to extend from lower surface 38 of body 26. This is achieved by screwing down the bolts 126 so that respective shanks of bolts 126 can protrude below surface 38. This assists in breaking a seal between mantle 12" and a cone head of a corresponding cone crusher. In addition jacking system 124 may assist in turning the device 12".

Releasable locking mechanism 56 of device 10" comprises a pin 130 that is biased to extend radially from circumferential surface 40 and is retractable in opposition to the bias for example by pulling on a knob 132 attahed to pin 130. Pin 130 slides within a hole 134 formed in a pin housing 136 which in turn is integrally formed with body 26.

Now that an embodiment of the present invention has been described in detail it will be apparent to those skilled in the relevant art that numerous modifications and variations may be made without departing from the basic inventive concepts. For example, the embodiments depict the use of four members 48 in the device 10 for engaging the mantle 12. However a different number of members 48 may be used for example one, two or three. While one member 48 can be used, it is believed that safety will be enhanced by the provision of at least two members 48. When there is more than one member 48, the members 48 may be equally spaced about the circumferential surface 40 of the body 26. In a further variation the body 26 need not be in the form of a plug as illustrated in the drawings, but can for example be in the form of a ring or annulus with one or two lifting lugs extending either axially from an upper surface or radially from an inner circumferential surface. The lifting point 30 is described and illustrated as a lug fixed to or integrally formed with the body 26. But in an alternate embodiment the fixing point can be demountably coupled to the body 26. For example the fixing point may be in the form of a pin provided with an eye at one end to engage a lifting device and a screw thread at an opposite end which screws into a threaded hole formed in the body 26.

All such modifications and variations are deemed to be within the scope of the present invention the nature of which is to be determined from the above description.

The invention claimed is:

1. A mantle lifting device for facilitating lifting of a mantle having an axial opening by which the mantle is connectable to a head of a crusher, the mantle lifting device configured to enable the mantle to be placed on or removed from the head of the crusher when engaged with the axial opening of the mantle, the mantle lifting device comprising:

a body configured to selectively engage with and disengage from the axial opening in the mantle;

the body comprising a lifting point configured to be coupled with a lifting device wherein the lifting device lifts the mantle when the body is engaged with the mantle and the lifting point is engaged with the lifting device;

wherein the body comprises a plurality of members at at least two spaced apart locations to selectively engage with and disengage from the axial opening, wherein the members and lifting point are configured such that the engagement and disengagement of the members is performed by rotating the mantle lifting device in a plane lying perpendicular to the direction of the lifting force, wherein the lifting point comprises a lug releasably coupled to the body; and wherein the body comprises a central portion provided with an axially extending hole and wherein the lug is releasably coupled to the body by engagement with the hole.

2. The mantle lifting device according to claim 1 wherein the members extend radially from a circumferential surface of the body.

3. The mantle lifting device according to claim 1, wherein two or more of the members are equally spaced about the body.

4. The mantle lifting device according to claim 1, further comprising a releasable locking mechanism for locking the body when engaged with the mantle against disengagement from the mantle.

5. The mantle lifting device according to claim 4 wherein the releasable locking mechanism comprises a bolt movably supported on the mantle lifting device, the bolt being selectively movable into and out of a seat in the mantle.

6. The mantle lifting device according to claim 4 wherein the releasable locking mechanism comprises a pin biased to extend generally radially from the body and retractable in opposition to the bias to enable disengagement of the body from the mantle.

7. The mantle lifting device according claim 1, further comprising a jack system coupled to the body and operable to extend from a lower surface of the body.

8. The mantle lifting device according to claim 7 wherein the jack system comprises one or more bolts to threadingly engage with respective axially extending through holes formed in the body.

9. The mantle lifting device according to claim 1 wherein the body comprises indicia located so that the indicia are covered by the mantle when the mantle lifting device is engaged with the mantle and the mantle in the vicinity of the axial opening is worn by more than a predetermined amount.

10. The mantle lifting device according to claim 1, further comprising for each of the members a corresponding marking on an upper surface of the body in axial alignment therewith.

11. A mantle lifting device for facilitating lifting of a mantle having an axial opening by which the mantle is connectable to a head of a crusher, the mantle lifting device configured to enable the mantle to be placed on or removed from the head of the crusher when engaged with the axial opening of the mantle, the mantle lifting device comprising:

a body configured to selectively engage with and disengage from the axial opening in the mantle;

the body comprising a lifting point configured to be coupled with a lifting device wherein the lifting device lifts the mantle when the body is engaged with the mantle and the lifting point is engaged with the lifting device;

wherein the body comprises a plurality of members at at least two spaced apart locations to selectively engage with and disengage from the axial opening, wherein the members and lifting point are configured such that engagement and disengagement of the members is performed by rotating the mantle lifting device in a plane lying perpendicular to the direction of the lifting force; and wherein the members are selectively extendible from and retractable into the body wherein the mantle lifting device is engaged with the mantle by locating the body in the axial opening and extending the members from the body; and, disengaged from the mantle by retracting the members into the body.

12. A mantle for a cone crusher, the mantle comprising:

a substantially frustoconical wall having a large diameter end and an axially opposite small diameter end, the small diameter end provided with an axial opening configured to receive a mantle lifting device for facilitating lifting of a mantle, the mantle lifting device configured to enable the mantle to be placed on or removed from the head of the crusher when engaged with the axial opening of the mantle, the mantle lifting device comprising:

a body configured to selectively engage with and disengage from the axial opening in the mantle;

the body comprising a lifting point configured to be coupled with a lifting device wherein the lifting device lifts the mantle when the body is engaged with the mantle and the lifting point is engaged with the lifting device;

wherein the body comprises a plurality of members at at least two spaced apart locations to selectively engage with and disengage from the axial opening, wherein the members and lifting point are configured such that engagement and disengagement of the members is performed by rotating the mantle lifting device in a plane lying perpendicular to the direction of the lifting force; and wherein the axial opening is provided with a circumferential wall and at least one recess in the circumferential wall to selectively engage with and disengage from the mantle lifting device.

13. The mantle according to claim 12 wherein the axial opening in the mantle is between first and second edges of the mantle and each recess extends in an axial direction and opens onto both of the edges.

14. The mantle according to claim 12 wherein the circumferential wall of the axial opening in the mantle is between first and second edges of the mantle, and the recess defines a first portion that extends axially between the first and second edges, and a second contiguous portion which extends circumferentially and under cuts the first edge.

15. A method of lifting a mantle having an axial opening by which the mantle is connectable to a head of a crusher, the method comprising:

providing a mantle lifting device configured to enable the mantle to be placed on or removed from the head of the crusher when engaged with the axial opening of the mantle, the mantle lifting device comprising:

a body configured to selectively engage with and disengage from the axial opening in the mantle;

the body comprising a lifting point configured to be coupled with a lifting device wherein the lifting device lifts the mantle when the body is engaged with the mantle and the lifting point is engaged with the lifting device;

wherein the body comprises a plurality of members at at least two spaced apart locations to selectively engage with and disengage from the axial opening, wherein the members and lifting point are configured such that engagement and disengagement of the members is performed by rotating the mantle lifting device in a plane lying perpendicular to the direction of the lifting force; and configuring the axial opening in the mantle to enable selective engagement with and disengagement from the mantle lifting device;

inserting the mantle lifting device into the axial opening and manipulating the mantle lifting device to engage the mantle lifting device with the mantle;

coupling the lifting point with a lifting device; and, operating the lifting device to lift the mantle.

16. A mantle lifting device for facilitating lifting of a mantle having an axial opening, the mantle lifting device comprising:

a body configured to selectively engage with and disengage from the axial opening in the mantle;

the body comprising a lifting point configured to be coupled with a lifting device wherein the lifting device lifts the mantle when the body is engaged with the mantle and the lifting point is engaged with the lifting device;

the mantle lifting device further comprising a releasable locking mechanism for locking the body when engaged with the mantle against disengagement from the mantle, wherein the releasable locking mechanism comprises a bolt movable supported on the device, the bolt being selectively movable into and out of a seat formed in the mantle.

17. A mantle lifting device for facilitating lifting of a mantle having an axial opening, the mantle lifting device comprising:

a body configured to selectively engage with and disengage from the axial opening in the mantle;

the body comprising a lifting point configured to be coupled with a lifting device wherein the lifting device lifts the mantle when the body is engaged with the mantle and the lifting point is engaged with the lifting device;

the mantle lifting device further comprising a releasable locking mechanism for locking the body when engaged with the mantle against disengagement from the mantle, wherein the releasable locking mechanism comprise a pin biased to extend generally radially from the body and retractable in opposition to the bias to enable disengagement of the body from the mantle.

18. A mantle lifting device for facilitating lifting of a mantle having an axial opening, via which the mantle is connectable to a head of a crusher, the mantle lifting device configured to enable the mantle to be placed on or removed from the head of the crusher when engaged with the axial opening of the mantle, the mantle lifting device comprising:

a body configured to selectively engage with and disengage from the axial opening in the mantle;

the body comprising a lifting point configured to he coupled with a lifting device wherein the lifting device lifts the mantle when the body is engaged with the mantle and the lifting point is engaged with the lifting device;

wherein the body comprises a plurality of members at at least two spaced apart locations to selectively engage with and disengage from the axial opening, and at least one member is linearly moveable away from and towards the body, wherein the mantle lifting device is: engaged with the mantle by locating the body in the axial opening and linearly moving the at least one member away from the body; and, disengaged from the mantle by linearly moving at least one member towards the body.

19. The mantle lifting device according to claim 18 wherein the members extend radially from a circumferential surface of the body.

20. The mantle lifting device according to claim 18 wherein the members are equally spaced about the body.

21. The mantle lifting device according to claim 18 wherein the lifting point comprises a lug coupled to the body.

22. The mantle lifting device according to claim 21 wherein the lug is releasably coupled to the body.

23. The mantle lifting device according to claim 22 wherein the body comprises a central portion provided with an axially extending hole and wherein the lug is releasably coupled to the body by engagement with the hole.

24. The mantle lifting device according to claim 18, further comprising a releasable locking mechanism for locking the body when engaged with the mantle against disengagement from the mantle.

25. The mantle lifting device according to claim 18, further comprising a jack system coupled to the body and operable to extend from a lower surface of the body.

26. The mantle lifting device according to claim 18 wherein the body comprises indicia located so that the indicia are covered by the mantle when the mantle lifting device is engaged with the mantle and the mantle in the vicinity of the axial opening is worn by more than a predetermined amount.

27. A mantle for a cone crusher, the mantle comprising:

a substantially frustoconical wall having a large diameter end and an axially opposite small diameter end, the small diameter end provided with the axial opening configured to receive a mantle lifting device according to claim 18; wherein the axial opening is provided with a circumferential wall and at least one recess in the circumferential wall to selectively engage with and disengage from the mantle lifting device.

28. A method of lifting a mantle comprising:

providing a mantle lifting device according to claim 18;

configuring the axial opening in the mantle to enable selective engagement with and disengagement from the mantle lifting device;

inserting the mantle lifting device into the axial opening and manipulating the mantle lifting device to engage the mantle lifting device with the mantle;

coupling the lifting point with a lifting device; and operating the lifting device to lift the mantle.

* * * * *